US009994390B2

(12) United States Patent
You

(10) Patent No.: US 9,994,390 B2
(45) Date of Patent: Jun. 12, 2018

(54) CONTAINER INCLUDING SLIDING ROOF

(71) Applicant: Ace Engineering & Co., Ltd., Seocho-gu, Seoul (KR)

(72) Inventor: In Sun You, Seoul (KR)

(73) Assignee: Ace Engineering & Co., Ltd., Seoul (KR)

( * ) Notice: Subject to any disclaimer, the term of this patent is extended or adjusted under 35 U.S.C. 154(b) by 272 days.

(21) Appl. No.: 15/024,584

(22) PCT Filed: Sep. 25, 2014

(86) PCT No.: PCT/KR2014/008951
§ 371 (c)(1),
(2) Date: Mar. 24, 2016

(87) PCT Pub. No.: WO2015/050338
PCT Pub. Date: Apr. 9, 2015

(65) Prior Publication Data

US 2016/0236859 A1 Aug. 18, 2016

(30) Foreign Application Priority Data

Oct. 1, 2013 (KR) ..... 10-2013-0117291

(51) Int. Cl.
*B65D 88/12* (2006.01)
*B65D 90/00* (2006.01)
*B65D 90/12* (2006.01)

(52) U.S. Cl.
CPC ..... *B65D 88/125* (2013.01); *B65D 90/008* (2013.01); *B65D 90/12* (2013.01)

(58) Field of Classification Search
CPC .. B65D 88/125; B65D 88/126; B65D 90/008; B65D 90/12; B65D 90/587
See application file for complete search history.

(56) References Cited

U.S. PATENT DOCUMENTS 3,472,548 A * 10/1969 Comisac ..... B60H 1/00014 296/100.05
3,756,650 A * 9/1973 Michel ..... B60J 7/062 296/100.12

(Continued)

FOREIGN PATENT DOCUMENTS

JP 62-028382 A 2/1987
JP 11-222289 A 8/1999

(Continued)

*Primary Examiner* — Anthony Stashick
*Assistant Examiner* — James Way
(74) *Attorney, Agent, or Firm* — Rutan & Tucker, LLP

(57) ABSTRACT

The present invention relates to a container having a collapsible frame coupled to one side of a sliding roof that defines an upper side of the container. According to one aspect of the present invention, the container may include a collapsible frame that is pivotably coupled to one side of the container, and the sliding roof which defines the upper side of the container. The sliding roof may be configured to slide like a vertical blind along the upper side of the container in a direction from the side opposite to the one side toward the one side of the container, and to open the upper side of the container. The sliding roof may be configured to move past a first side of the container through the collapsible frame, and the collapsible frame may be configured to support the sliding roof when the sliding roof moves past the first side of the container.

10 Claims, 5 Drawing Sheets

(56) References Cited

U.S. PATENT DOCUMENTS 3,986,749 A * 10/1976 Hull ..... B60J 7/024 160/84.06
4,215,897 A * 8/1980 Aiken ..... B60J 7/062 296/100.11
4,277,098 A * 7/1981 Gibney ..... B60J 7/141 296/100.09
4,784,427 A * 11/1988 Burgess ..... B60J 7/068 160/314
4,842,323 A * 6/1989 Trickett ..... B60J 7/085 105/377.02
4,858,984 A * 8/1989 Weaver ..... B60J 7/062 296/100.11
4,995,663 A * 2/1991 Weaver ..... B60J 7/062 296/100.11
5,125,713 A * 6/1992 Willingham ..... B60P 7/04 160/242
5,167,341 A * 12/1992 Morton ..... B61D 39/002 105/377.09
5,429,408 A * 7/1995 Henning ..... B60J 7/062 296/100.12
5,938,270 A * 8/1999 Swanson ..... B60J 7/062 296/100.11
6,142,554 A * 11/2000 Carroll ..... B60J 7/062 296/100.11
6,474,718 B1 * 11/2002 Henning ..... B60J 7/085 296/98
6,938,960 B1 * 9/2005 Eby ..... B60J 7/1621 296/100.08
7,296,842 B2 * 11/2007 Growcock ..... B60J 7/085 296/100.01
7,726,720 B2 * 6/2010 Searfoss ..... B60J 7/085 296/100.01
8,172,301 B2 * 5/2012 Searfoss ..... B60J 7/085 296/98
8,474,896 B2 * 7/2013 Ostberg ..... B62D 33/0273 296/100.02
8,550,532 B2 * 10/2013 Reeder ..... B60J 7/085 296/98
9,027,980 B1 * 5/2015 Fliegl, Jr. ..... B65D 88/125 296/100.1
2009/0159592 A1 * 6/2009 Vitalis ..... B65D 88/125 220/1.5
2011/0297687 A1 * 12/2011 Nam ..... B65D 88/125 220/640
2013/0062025 A1 * 3/2013 Bromberek ..... B65D 43/02 160/242
2014/0361012 A1 * 12/2014 McKibben ..... B60J 7/06 220/260
2015/0203293 A1 * 7/2015 Boesch ..... B65F 1/1646 220/813
2016/0137404 A1 * 5/2016 Steiner ..... B60P 1/28 220/1.5
2016/0312487 A1 * 10/2016 Gambarotta ..... E04H 6/005
2016/0332557 A1 * 11/2016 Royer ..... B65D 88/125

FOREIGN PATENT DOCUMENTS

JP 2004-269005 A 9/2004
KR 20-1986-0003744 4/1986
KR 10-2002-0093265 A 12/2002

* cited by examiner

CONTAINER INCLUDING SLIDING ROOF

This patent application is a 35 U.S.C. § 371 Application of International Patent Application Number PCT/KR2014/008951, titled "CONTAINER INCLUDING SLIDING ROOF" having an International Filing Date of Sept. 25, 2014, and International Patent Application Number PCT/KR2014/008951 claims priority to Korean Application Number 10-2013-0117291 filed Oct. 01, 2013, both of which are incorporated herein by reference in its entirety.

TECHNICAL FIELD

The present design relates to a container, and more particularly, to a container having a sliding member provided at an upper side of the container.

BACKGROUND

A container refers to a container in the form of a box, that is used to efficiently transport freight, that is, a large-scale freight transportation container that is implemented to enable the loading and unloading work to be quickly carried out, to be usable repeatedly, to store luggage for a long period of time, and to transport luggage through various transportation means.

However, general hermetic containers have a fixed size (e.g., a height of 8.6 feet) defined by the international standard (e.g., ISO standard), and as a result, there is a problem in that the general hermetic container cannot be easily used to store and transport luggage having a dimension exceeding the standard. Moreover, in the case of a container with an openable roof in the related art, a plurality of roof beam sockets is installed at an equal interval at upper ends of two side walls of the container, two opposite ends of the roof beam are detachably attached to the sockets, a cover covers the two opposite ends of the roof beam, and a rim of the cover is bound and fixed by a rope. Therefore, in the case of the container with the openable roof in the related art, since operations of tightening or loosening the fixing rope, covering or uncovering the cover, and installing or detaching the roof beam to or from the socket one by one are carried out to open or close the upper side of the container, there is a problem in that inefficiency exists at the time of opening or closing the upper side of the container.

As associated literature of the related art, there is a Korean Patent Application Laid-Open No. 10-2002-0093265 published on Dec. 16, 2002, and entitled "Open Top Container Including Opening and Closing Device".

DISCLOSURE

Technical Problem

The present design has been made taking into account of the aforementioned problem, and an object of the present design is to provide a container having a collapsible frame coupled to one side of a sliding roof that defines an upper side of the container.

Technical Solution

Technical features of the present design for achieving the object of the present design and unique effects of the present design to be described below will be described below.

According to one aspect of the present design, the container may include a collapsible frame that is coupled to a first side of the container, and a sliding roof which defines the upper side of the container. The sliding roof may be configured to open the upper side of the container by sliding like a vertical blind in a direction from a second side to the first side of the container. That is, the container may include: a collapsible frame that is coupled to a first side of the container and pivotable about an upper end portion at the first side; and a sliding roof that is provided with a plurality of beams which connect an upper end portion at a third side and an upper end portion at a fourth side of the container, and are connected to each other by a roof member, and defines an upper side of the container, in which the sliding roof is configured to slide in a collapsible manner along the upper side of the container in a direction from a second side to the first side of the container, and to be placed on the collapsible frame past the first side, the first side and the second side are positioned to be opposite to each other, and the third side and the fourth side are positioned to be opposite to each other. In addition, the second side may include a door that opens outward from the container.

According to one aspect of the present design, the sliding roof may include a plurality of beams, and wires may be connected in parallel with a first beam and a second beam, which may come into contact with the first side and the second side of the container among the plurality of beams, respectively, in order to unlock the sliding roof.

According to one aspect of the present design, the collapsible frame may be provided with a collapsible stand and a collapsible connecting portion, the collapsible stand may be configured to be pivotably coupled to an upper end portion at the first side of the sliding roof and to support the sliding roof, and the collapsible connecting portion may include two first side bars which are coupled to two opposite ends at the first side of the container, respectively, two second side bars which are coupled to two opposite ends of the collapsible stand, respectively, and a connecting bar which connects the first and second side bars. In addition, the second side bars of the collapsible connecting portion may rotate about the connecting bar until the collapsible stand becomes parallel with the upper side of the container, and to support the stand. Moreover, the collapsible stand may be provided with at least one beam.

According to one aspect of the present design, upper end inner portions at the third side and the fourth side of the container may be provided with locking points including a groove, that is disposed toward the interior of the container, so as to fix the first beam and the second beam of the sliding roof, that is in contact with the first side and the second side of the container, respectively, in order to prevent the sliding roof from moving.

According to a further aspect of the present design, a container includes: a frame which extends from one end portion at a first side of the container; and a sliding roof that is provided with a plurality of beams which connect an upper end portion at a third side and an upper end portion at a fourth side of the container, and are connected to each other by a roof member, and defines an upper side of the container, in which the sliding roof is configured to slide in a collapsible manner along the upper side of the container in a direction from a second side to the first side of the container, and to be placed on the frame past the first side, the first side and the second side are positioned to be opposite to each other, and the third side and the fourth side are positioned to be opposite to each other.

Advantageous Effects

Since the container according to the example embodiment of the present design has the sliding roof and the collapsible frame, the sliding roof may be supported by the collapsible frame and may fully open the upper side of the container, and since the sliding roof may be prevented from moving in a situation in which the sliding roof is closed, by forming a groove at a locking point at an upper side at a side of the container, the upper side of the container may be effectively fixed.

Since the upper side of the container according to the example embodiment of the present design may be more conveniently opened and closed in a sliding manner without separating constituent elements, it is possible to more efficiently open and close the roof compared to the container with an openable roof in the related art.

Since the upper side of the container according to the example embodiment of the present design may be simply opened and closed without using a power transmission or drive device, it is possible to more easily manage the container compared to the container including the power transmission device, and the container according to the example embodiment of the present design may be more efficient in terms of maintenance and manufacturing costs of the container.

Various example embodiments and/or aspects will now be disclosed with reference to the drawings. A plurality of detailed matters will be disclosed for helping overall understanding of one or more aspects for the purpose of description in the following description. However, a person with ordinary skill in the art to which the present invention pertains will also recognize that these aspects can be implemented without such detailed matters. Hereinafter, specific example aspects for one or more aspects will be described in detail in the following description with reference to the accompanying drawings. However, these aspects are illustrative only, and various methods in principles for various aspects can be partially used, and the following description is intended to include all the aspects and equivalents thereto.

Further, the term "or" is intended to mean an inclusive "or" rather than an exclusive "or." In other words, unless otherwise defined or unless the context clearly indicates otherwise, the expression "X uses A or B" is referred to as any one of natural inclusive permutations. That is to say, if X uses A, X uses B, or X uses both A and B, "X uses A or B" satisfies any embodiments mentioned above. It should be further understood that the term "and/or" used herein refers to and includes all possible combinations of one or more of the associated listed items.

It should be further understood that the terms "comprises (includes)" and/or "comprising (including)" used herein mean the presence of stated features and/or constituent elements, but do not exclude the presence or addition of one or more other features, constituent elements and/or groups thereof. Further, unless otherwise specified or if it is contextually unclear that the term indicates a singular form, it should be understood that a singular form in the present specification and the claims generally means "one or more".

Figure 1:
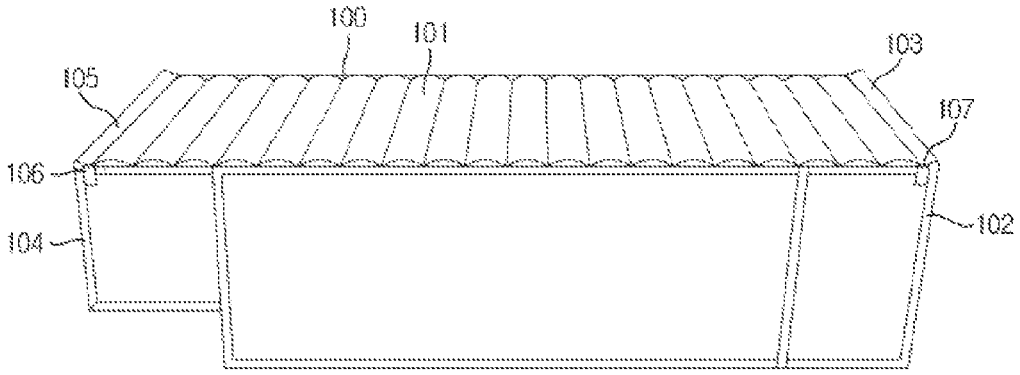
FIG. 1 is a perspective view of a container according to an example embodiment of the present design.

FIG. 1 illustrates a container 100 provided with a sliding roof 101 according to an example embodiment of the present design. In one aspect, the container 100 may include the sliding roof 101 which defines an upper side of the container 100, a door 104 which defines one side of the container 100, and a collapsible frame 102 that is coupled to the opposite side to the door 104. The sliding roof 101 includes a plurality of beams, and wires are connected in parallel with beams 103 and 105 which are positioned at two opposite ends of the plurality of beams, such that the movement of the sliding roof may be unlocked. In a further example embodiment, the plurality of beams may be disposed at an equal interval, but the arrangement interval is not limited to the equal interval. The plurality of beams may be connected to each other by a roof member that may be made of a finishing material. In addition, each of the plurality of beams may have a curved shape. In a further example embodiment of the present design, the container 100 may include a frame (not illustrated) coupled to one end portion at one side of the container, and the frame may be detachable and/or fixed. In the case of the detachable frame, the container 100 and the frame may be separated and stored, and when the sliding roof is opened, the frame is coupled to one end portion at one side of the container, such that the sliding roof may extend by being supported by the frame. The operation of the frame of the container 100 may support the sliding roof in various ways so that the sliding roof may extend past the upper side of the container.

In the example embodiment of the present design, particular positions, which face each other at upper sides of the other sides of the container, may be referred to as locking points 106 and 107, and grooves for fixing the movement of the sliding roof 101 are formed at the locking points 106 and 107, respectively. Therefore, since the sliding roof 101 is fixed by the groove, it is possible to prevent the movement of the sliding roof 101 in a state in which the upper side of the container is closed. An operation of unlocking the sliding roof 101 fixed to the groove may be carried out by using the wires that are connected in parallel with the beams 103 and 105 positioned at the two opposite ends as described above.

In the example embodiment of the present design, based on the principle of a vertical blind, the sliding roof 101 may move while opening the upper side of the container 100 when at least one portion (i.e., a pulling portion) at one side edge of the sliding roof 101 is pulled in the opposite direction. That is, a degree to which the sliding roof 101 is collapsed (i.e., a height of the collapsed sliding roof) may be based on the intervals at which the plurality of beams is disposed. In the example embodiment of the present design, two opposite edges at the upper side of the container 100 along which the sliding roof 101 moves may be formed as aluminum rails.

In this case, the sliding roof 101, that is in contact with the two opposite edges at the upper side of the container 100, may include a plurality of beams, and at least one wheel is coupled to each of the two opposite ends of the plurality of beams, such that the sliding roof 101 may easily move on the aluminum rails. Grooves are formed upward in the aluminum rail so as to be coupled to the at least one wheel. In addition, the wheel may be made of, but not limited to, plastic or steel. In a further example embodiment of the present design, the sliding roof 101 is coupled to a drive device such as a motor, and may automatically move while opening the upper side of the container 100.

Figure 2:
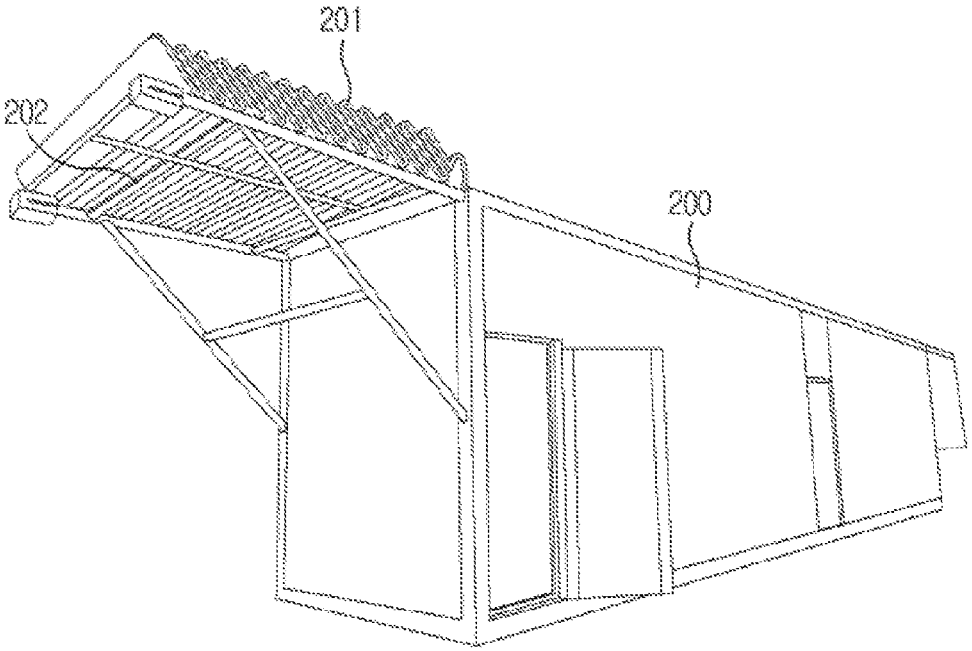
FIG. 2 illustrates the container in a state in which a sliding roof is fully opened according to the example embodiment of the present design.

FIG. 2 illustrates a sliding roof 201 that is fully opened according to the example embodiment of the present design. Referring to FIG. 2, the sliding roof 201 may move past the upper side of a container 200 so as to fully open the upper side of the container 200. A collapsible frame 202 coupled to one side of the container may be unfolded so as to support the sliding roof 201 so that the sliding roof 201 may move past the one side of the container 200. In a further example embodiment of the present design, the collapsible frame 202 is coupled to a drive device and may be automatically folded or unfolded. The collapsible frame 202 may include a collapsible stand which supports the sliding roof 201, and a collapsible connecting portion that is coupled between the collapsible stand and the container 200 and may support the collapsible stand. In the example embodiment of the present design, the collapsible stand may have at least one beam, and the collapsible connecting portion may have an H shape. The collapsible connecting portion is coupled to one side of the container and unfolded in a diagonal direction so as to support the collapsible stand so that the collapsible stand is in parallel with the upper side of the container. That is, the collapsible frame may be provided with the collapsible stand and the collapsible connecting portion, and the collapsible stand may be pivotably coupled to an upper end portion at one side of the sliding roof, and may support the sliding roof when the collapsible stand is unfolded in parallel with the upper side of the container. In addition, the collapsible connecting portion may include two side bars (i.e., two first side bars) which are coupled to two opposite ends at one side of the container, respectively, two side bars (i.e., two second side bars) which are coupled to two opposite ends of the collapsible stand, respectively, and a connecting bar which connects the first and second side bars. In the example embodiment of the present design, the two second side bars of the collapsible connecting portion may rotate about the connecting bar until the collapsible stand becomes parallel with the upper side of the container, thereby supporting the stand. When the collapsible frame 202 is unfolded, one side of the container 200, the collapsible stand, and the collapsible connecting portion may define a triangle. In a further example embodiment of the present design, grooves may be formed at two opposite edges of the collapsible stand, thereby fixing the collapsible stand and the connecting portion so that the unfolded state of the collapsible frame 202 is maintained. In this case, it is possible to prevent the collapsible frame 202, which supports the sliding roof 201, from being arbitrarily folded.

As illustrated in FIG. 2, as the sliding roof 201 is completely moved toward an upper side of the collapsible frame 202, the upper side of the container 200 may be fully opened. In addition, in a further example embodiment of the present design, a degree to which the upper side of the container 200 is opened may be adjusted by changing the arrangement of the grooves formed at the locking points of the container 200 or appropriately changing the movement amount of the sliding roof 201 by using the plurality of grooves. Therefore, the upper side of the container is appropriately opened or fully opened, such that luggage having a height exceeding the ISO standard may be easily transported. In addition, the container may be transported in a state in which the collapsible frame 202 is folded, thereby efficiently transporting the container. Moreover, unlike the container with an openable roof in the related art, in the case of the container according to the present design, the upper side of the container may be opened without removing components, and a degree to which the container is opened may be easily adjusted by the appropriate arrangement of the locking points and the easy unlocking operation of pulling the wire, thereby more efficiently stacking luggage.

In a further example embodiment of the present design, in a case in which the sliding roof 201 is supported by the collapsible frame 202 and the sliding roof 201 extends to fully open the upper side of the container 200 as illustrated in FIG. 2, a length of the folded sliding roof 201 may be shorter than a length of the collapsible frame 202 that is unfolded and raised up.

Figure 3:
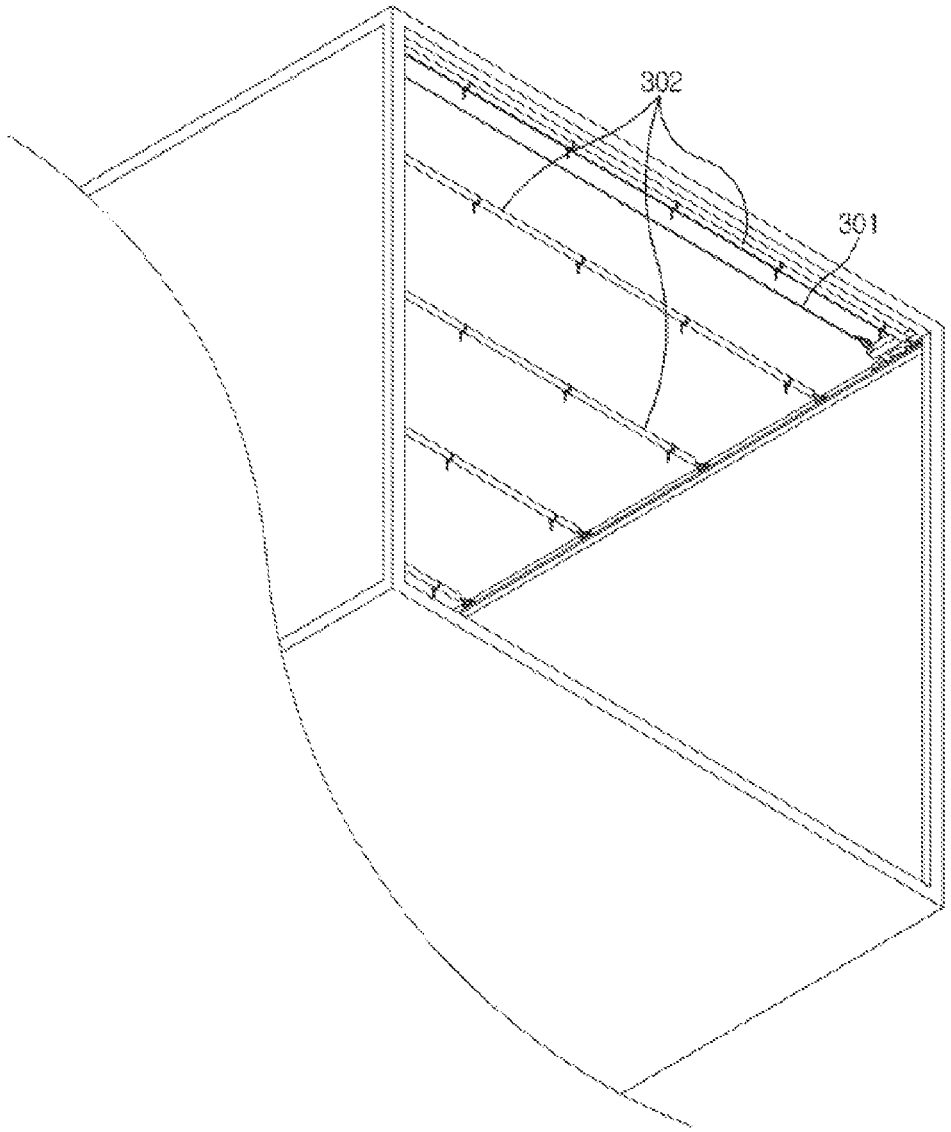
FIG. 3 illustrates an interior at an upper side of the container according to the example embodiment of the present design.

FIG. 3 illustrates an interior at the upper side of the container (i.e., the sliding roof) according to the example embodiment of the present design. The sliding roof of the container may include a plurality of beams 302. Wires 301 are connected to the beams positioned at two opposite ends of the plurality of beams, such that the movement of the sliding roof may be unlocked. That is, in a state in which the sliding roof is completely closed, the beams positioned at two opposite ends of the sliding roof are fixed by the grooves formed at the locking points, respectively. In this case, when the wire 301, that is connected to each of the beams positioned at the two opposite ends, is pulled downward, the beam connected to the wire 301 may be separated from the groove formed at the locking point. Therefore, the beam, that is separated from the groove, is unlocked and may move along the upper side of the container.

Figure 4:
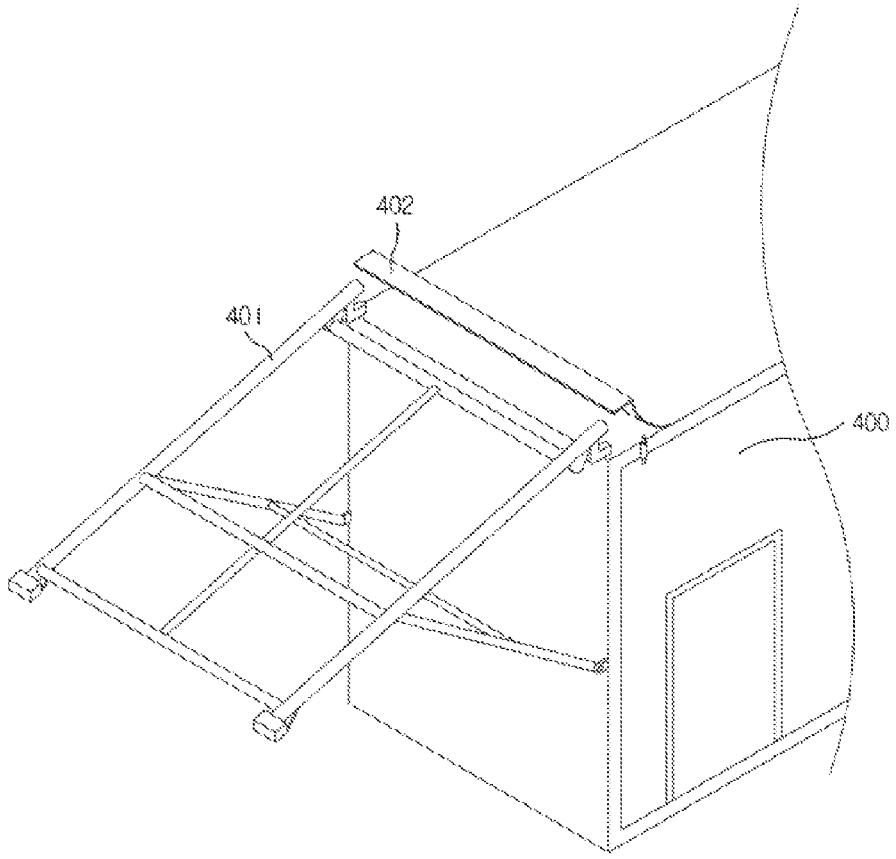
FIG. 4 illustrates an operation of a collapsible frame coupled to one side of the container according to the example embodiment of the present design.

FIG. 4 illustrates an operation of a collapsible frame 401 coupled to one side of a container 400 according to the example embodiment of the present design. As illustrated in FIG. 4, the collapsible frame 401 may be coupled to one side of the container 400. The collapsible frame 401 may be unfolded upward after a beam 402 of the sliding roof, which may come into contact with the one side, is raised up. In a further example embodiment of the present design, the collapsible frame 401 may include a locking device.

Figure 5:
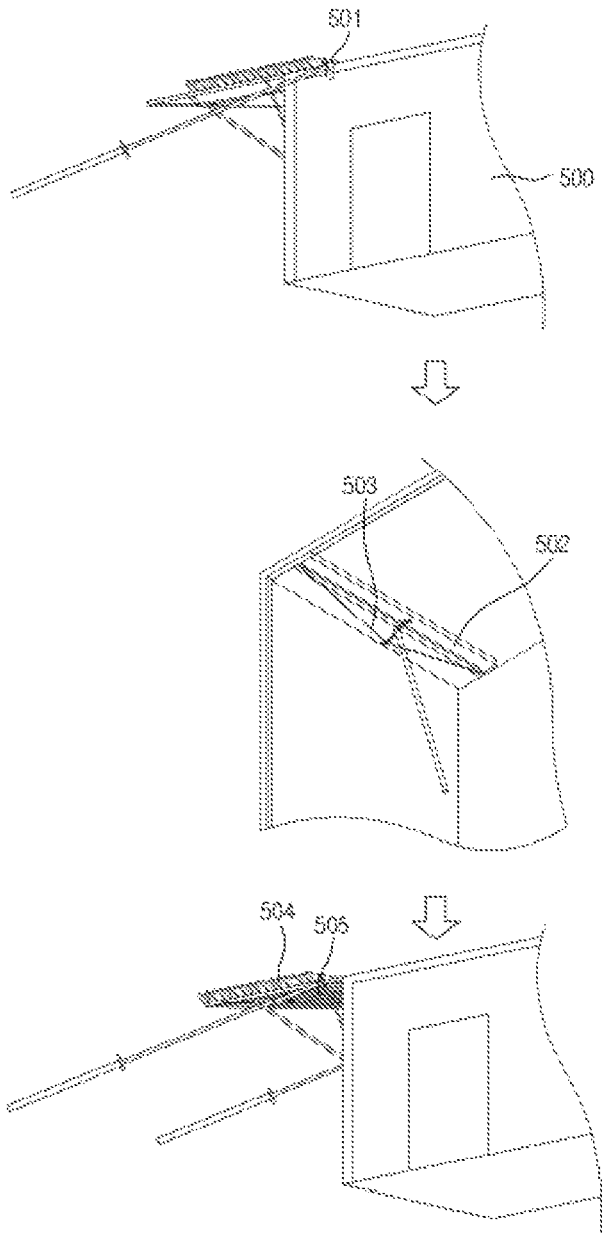
FIG. 5 illustrates a series of operations of opening the sliding roof according to the example embodiment of the present design.

FIG. 5 illustrates a series of operations of opening the sliding roof.

However, the series of operations are not limited to the sequence of the operations according to the example embodiment which will be described below. The operations of opening the sliding roof according to the example embodiment of the present design will be described below.

First, a door of a container 500 is opened, and a rear portion of the sliding roof (i.e., a rear beam fixed at a rear locking point) is unlocked by using the wire connected to the beam (i.e., the rear beam) of the sliding roof that is in contact with one side (i.e., a rear side) formed by the door. To unfold and raise up a collapsible frame 505 coupled to the opposite side (i.e., a front side) to the one side, a beam (i.e., a front beam) of the sliding roof, that is in contact with the opposite side (i.e., the front side), is raised up. Thereafter, a front portion of the sliding roof (the front beam fixed at a front locking point) is unlocked by using the wire connected to the beam (i.e., the front beam) of the sliding roof that is in contact with the opposite side (i.e., the front side). As illustrated in FIG. 5, a sliding roof 504 may move up to a front locking point 501 while being folded. In a case in which a rear beam 502 of the sliding roof 504 reaches the front locking point 501, a groove and the rear beam 502 may be uncoupled at the front locking point 501 by using a wire 503 connected to the rear beam 502. Therefore, as illustrated in FIG. 5, the sliding roof 504 may fully open the upper side of the container 500.

In the example embodiment of the present design, the operations of closing the sliding roof may be carried out in the reverse order to the aforementioned operations of opening the sliding roof. More specifically, referring to the operations of closing the sliding roof, the rear beam of the sliding roof may be fixed by the groove positioned at the front locking point when the fully opened sliding roof is closed to the front locking point. In this case, after the locked (fixed) state is released by using the wire connected to the rear beam, the sliding roof may be fully closed to the rear beam locking point. Thereafter, when the collapsible frame is pushed downward, and the front beam is lowered downward and closed, the operation of closing the sliding roof may be completed.

Figure 6:
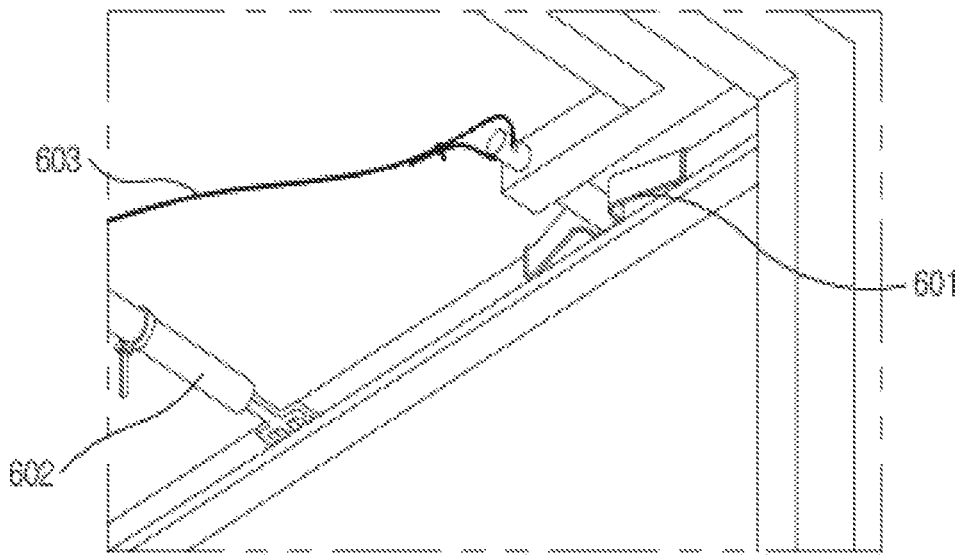
FIG. 6 illustrates a locking point for fixing a front beam or a rear beam of the sliding roof according to the example embodiment of the present design.

FIG. 6 illustrates a locking point 603 for fixing the front beam or the rear beam of the sliding roof. Although a single beam is illustrated in FIG. 6, the sliding roof, which defines the upper side of a container 600, may include a plurality of beams 602. As illustrated in FIG. 6, the locking point 601 may include grooves, such that the beams, which are positioned at two opposite ends among the plurality of beams 602, may be attached to or detached from the grooves, respectively. In a case in which the beam is attached to the groove and the sliding roof is fixed, a wire 603 connected to the beam is pulled downward, such that the beam and the groove may be uncoupled as described above.

The description about the suggested example embodiments is provided so that a person with ordinary skill in the art to which the present design pertains may use or carry out the present design. Various modifications from the example embodiments will be obvious to the person skilled in the art, and general principles defined herein may be applied to other example embodiments without departing from the scope of the present design. Accordingly, the present design is not limited to the example embodiments suggested herein, but should be construed within the widest scope that complies with the principles suggested herein and novel features.

MODE FOR INVENTION

Contents related to the best mode for carrying out the invention has been described above.

INDUSTRIAL APPLICABILITY

The present design may be used for various containers such as a movable container, a camping container, an assembly type container, a steel container, and a modular container.

The invention claimed is:

1. A container, comprising:

a collapsible frame that is coupled to a first side of the container and pivotable about an upper end portion at the first side of the container; and a sliding roof that is provided with a plurality of beams which connect an upper end portion at a third side and an upper end portion at a fourth side of the container, and are connected to each other by a roof member, and that defines an upper side of the container, wherein the sliding roof is configured to slide in a collapsible manner along the upper side of the container in a direction from a second side to the first side of the container, and to be placed on the collapsible frame past the first side, the first, second, third, and fourth sides of the container are referred to as four different sides which are coupled to define an external appearance of the container, the first side and the second side of the container are positioned to be opposite to each other, the third side and the fourth side of the container are positioned to be opposite to each other, and upper end inner portions at the third side and the fourth side of the container are provided with locking points in the form of a groove so as to fix a first beam and a second beam of the sliding roof, that is in contact with the first side and the second side of the container, respectively, in order to prevent the sliding roof from moving.

2. The container of claim 1, wherein the second side includes a door that opens outward from the container.

3. The container of claim 1, wherein the sliding roof is configured to move while opening the upper side of the container like a vertical blind when at least one pulling portion at an upper side at the second side of the sliding roof is pulled in a direction toward the first side.

4. The container of claim 1, wherein the sliding roof is configured to be supported by the collapsible frame and to fully open the upper side of the container by moving past the first side of the container, and when the upper side of the container is fully opened, a length of the folded sliding roof is shorter than a length of the collapsible frame.

5. The container of claim 1, wherein the collapsible frame is provided with a collapsible stand and a collapsible connecting portion, the collapsible stand is configured to be pivotably coupled to an upper end portion at the first side of the sliding roof and to support the sliding roof, the collapsible connecting portion includes two first side bars which are coupled to two opposite ends at the first side of the container, respectively, two second side bars which are coupled to connect the two opposite ends of the collapsible stand and the two first side bars, respectively, and a connecting bar which connects the first and second side bars, and the first and second side bars of the collapsible connecting portion are configured to rotate about the connecting bar until the collapsible stand becomes parallel with the upper side of the container, and to support the stand.

6. The container of claim 5, wherein the collapsible stand is provided with at least one beam.

7. The container of claim 1, wherein the sliding roof further includes wires which are connected in parallel with the first beam and the second beam, which are in contact with the first side and the second side among the plurality of beams, respectively, in order to unlock the sliding roof.

8. The container of claim 1, wherein the roof member of the sliding roof is made of a finishing material.

9. The container of claim 1, wherein the sliding roof further includes wires which are connected in parallel with the first beam and the second beam, respectively, and when the wire is pulled downward and the beam moves in a direction toward the ground, the locking points of the container and the first and second beams are uncoupled, respectively.

10. A container, comprising:

a frame which extends from one end portion at a first side of the container; and a sliding roof that is provided with a plurality of beams which connect an upper end portion at a third side and an upper end portion at a fourth side of the container, and are connected to each other by a roof member, and defines an upper side of the container, wherein the sliding roof is configured to slide in a collapsible manner along the upper side of the container in a direction from a second side to the first side of the container, and to be placed on the frame past the first side, the first, second, third, and fourth sides are referred to as four different sides which are coupled to define an external appearance of the container, the first side and the second side are positioned to be opposite to each other, the third side and the fourth side are positioned to be opposite to each other, and upper end inner portions at the third side and the fourth side of the container are provided with locking points in the form of a groove so as to fix a first beam and a second beam of the sliding roof, that is in contact with the first side and the second side of the container, respectively, in order to prevent the sliding roof from moving.

* * * * *